US005341586A

United States Patent [19]

Aluotto et al.

[11] Patent Number: 5,341,586

[45] Date of Patent: Aug. 30, 1994

[54] STOCK EXTENDER

[76] Inventors: Peter A. Aluotto, 1668 Hendrickson St.; John A. Gulardo, 1866 E. 53 St., both of Brooklyn, N.Y. 11234

[21] Appl. No.: 864,647

[22] Filed: Apr. 7, 1992

[51] Int. Cl.[5] ..... F41A 9/65

[52] U.S. Cl. ..... 42/7; 42/76.02

[58] Field of Search ..... 42/7, 50, 71.02, 90, 42/106

[56] References Cited

U.S. PATENT DOCUMENTS

| | | | |
|---|---|---|---|
| 966,165 | 8/1910 | Cobb | 42/71.02 |
| 1,015,490 | 1/1912 | Harrington | 42/7 |
| 3,758,978 | 9/1973 | Theodore | 42/71.02 |
| 4,343,107 | 8/1982 | Kaltenegger | 42/7 |
| 4,520,585 | 6/1985 | Barrett | 42/7 |
| 4,862,619 | 9/1989 | Baldus et al. | 42/7 |

*Primary Examiner*—Stephen C. Bentley
*Attorney, Agent, or Firm*—Kane, Dalsimer, Sullivan, Kurucz, Levy, Eisele and Richard

[57] ABSTRACT

A stock extender for a handgun, such as, for example, a Colt 0.45 Officer's Model, comprises a collar which may be fit around and securely tightened to an ammunition magazine for a corresponding larger model of the same handgun, such as, for example, a Colt 0.45 Standard Model. The stock extender provides the handgun with a grip having the same length as that of the larger model handgun, and enables the handgun to be more comfortably and reliably handled and discharged by persons having large hands. The stock extender may be shaped to correspond to and match the circumferential shape of the stock of the gun with which it is used.

4 Claims, 2 Drawing Sheets

FIG. 1
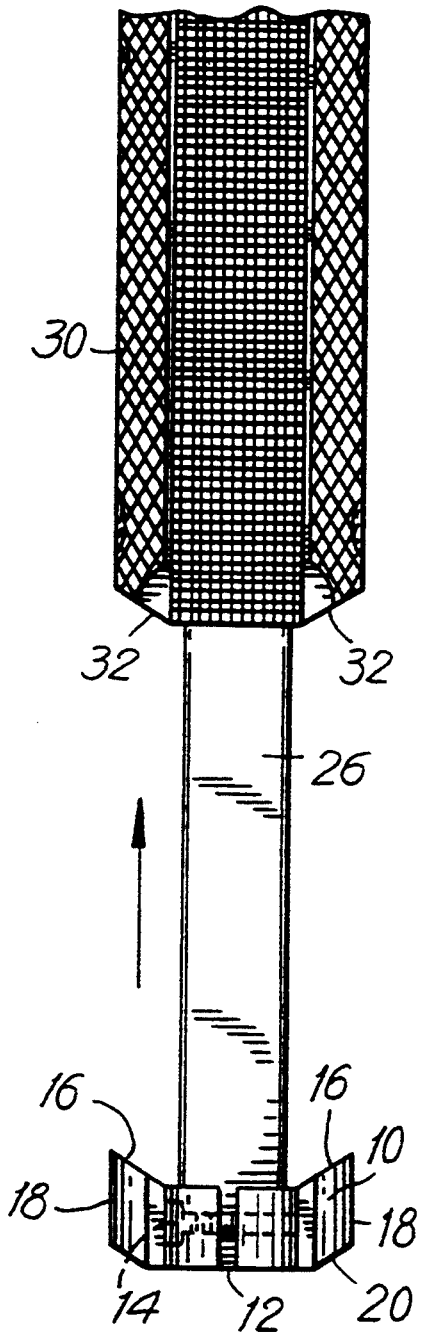
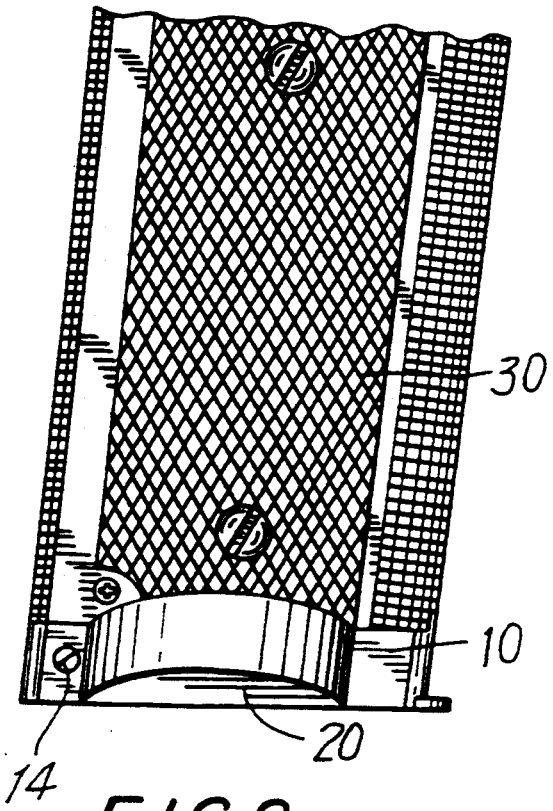
FIG. 2

FIG. 3
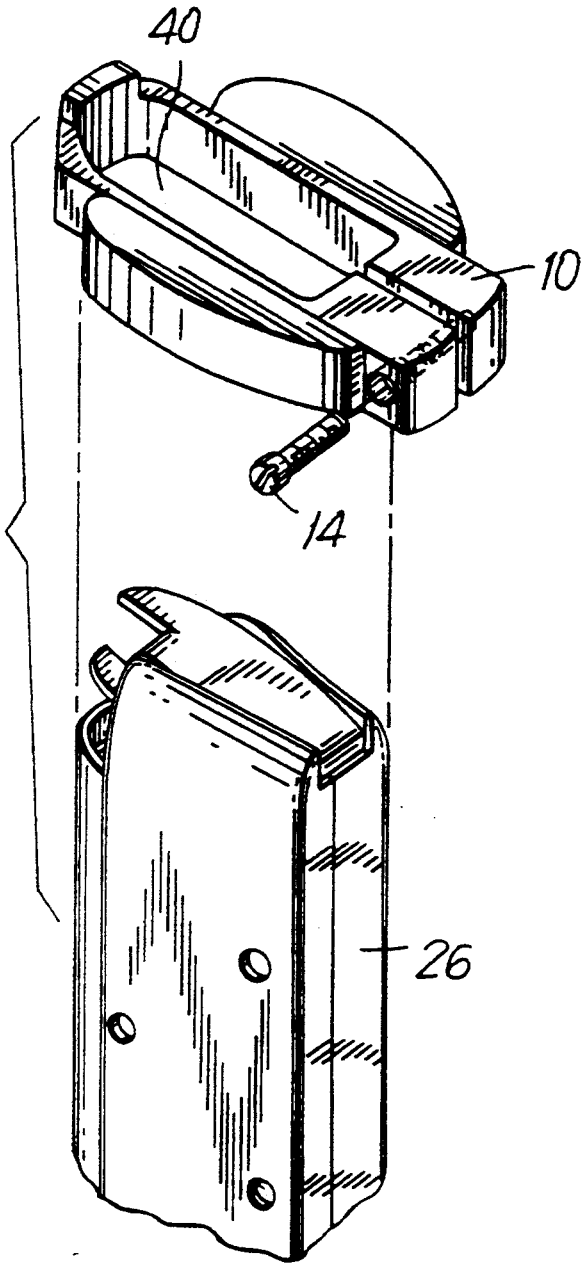
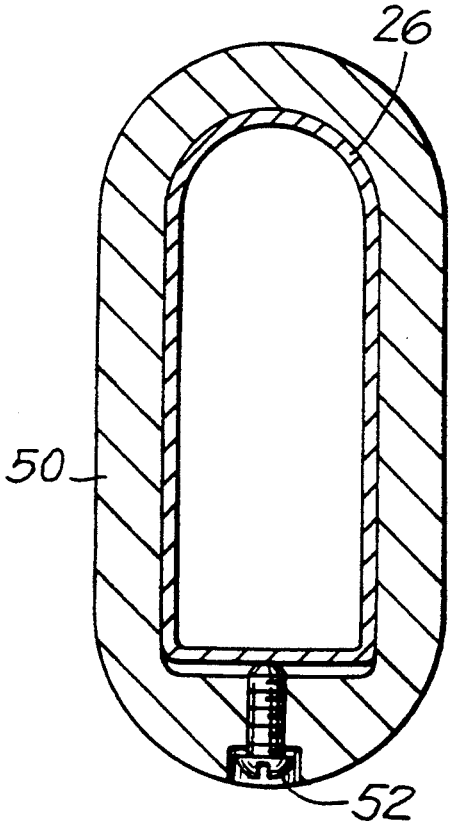
FIG. 4

STOCK EXTENDER

BACKGROUND OF THE INVENTION

1. Field of the Invention

The present invention generally relates to the field of handguns and small firearms. More specifically, the invention relates to the variety of handgun which may be loaded with ammunition by inserting a magazine into the lower end of its stock or handle.

2. Description of the Prior Art

Handguns of numerous varieties are widely used by police and military officers, as well as by civilian hobbyists and gun enthusiasts. Among the latter, target shooting of one kind or another attracts a large following.

Among the handguns used for such legitimate civilian purposes are reduced-size versions of standard models. Typically, the barrel and stock of these smaller versions are shorter than those characterizing the standard models, all other components of the standard and reduced-size models of the guns being identical. Of course, it follows that the magazine for the standard handgun is longer than that for the smaller version, and holds at least one additional round.

Although smaller handguns remain popular among gun enthusiasts because they are lighter and more compact than standard models, a user having a large hand may find that his little finger resides below the lower end of the stock when gripping the handgun. As a consequence, the large-handed user may not be able to grip the handgun as well as another user, whose hand is more comparable in size to the stock. The accuracy with which the large-handed user may fire the handgun will almost inevitably suffer.

The present invention addresses and provides a solution to these problems, and has been designed to enable a large-handed user to handle a small handgun more reliably and safely, and to enable him to grip such a handgun with his entire hand. When the grip is improved, better accuracy must follow.

SUMMARY OF THE INVENTION

The present invention is a stock extender designed to lengthen the stock of a small handgun by a nominal amount, so that all fingers of a larger-handed user may take part in gripping the stock during use of the gun.

The invention may find application with handguns of the variety which are loaded and unloaded by inserting an ammunition-bearing magazine into the lower end of the stock or handle. The stock extender itself is a collar, typically fashioned from a light-weight metal, such as aluminum, or other substance, such as plastic, which fits around a magazine of greater length than that ordinarily used with the handgun. Being generally in the shape of a collar, the stock extender defines an opening, through which the magazine may be inserted. The stock extender resides about the lower end of the magazine, the upper end being that inserted into the handgun to dispense ammunition into its firing chamber. Means may be provided on the stock extender to enable it to be tightened and secured firmly to the lower end of the magazine.

Preferably, the stock extender is shaped circumferentially to follow the contour of the frame, wood grips and other materials on the stock of the handgun, so that, when in use with the handgun, the stock extender affords the hand of a user a continuous, substantially smooth surface for gripping. Where the lower end of a stock is bevelled for aesthetic purposes, the stock extender may also be bevelled on the one hand to provide an intimate fit against the lower end of the stock, and on the other hand to provide the lower end of the stock extender with the same aesthetic appearance as that of the lower end of the stock.

The present invention will now be described more completely with reference being made to the several figures identified below.

BRIEF DESCRIPTION OF THE DRAWINGS

FIG. 1 is a back view of the stock of a handgun with a magazine having the stock extender of the present invention partially inserted thereinto;

FIG. 2 is a side view of the stock of a handgun with the stock extender of the present invention positioned at the lower end thereof.

FIG. 3 shows the stock extender of the present invention positioned over the upper end of an ammunition magazine.

FIG. 4 is a cross-sectional view of an alternate embodiment of the stock extender of the present invention disposed about an ammunition magazine.

DETAILED DESCRIPTION OF THE PREFERRED EMBODIMENT

As stated at the outset, the present invention may find application on the smaller version of the handgun having what may be referred to as a standard variant. For example, the Colt 0.45 Standard Model, also known as the 1911 Government Model, is used with a seven-round magazine, and is loaded and unloaded by inserting this magazine into the stock. This handgun has a smaller version referred to as the Colt 0.45 Officer's Model, which differs from the Standard Model, by having a shorter barrel and stock. Normally, the Officer's Model is used with a six-round magazine. The stock extender of the present invention, when placed and secured to the lower end of the standard seven-round magazine, may be used to lengthen the stock of the Officer's Model by an amount equal to the difference in length between the six-round magazine and the seven-round magazine, that is, by approximately an additional one-half inch. Accordingly, the stock extender, when used with the standard seven-round magazine, can provide the Officer's Model with a stock equivalent in overall length to that of the Standard Model.

More broadly and generally stated, a handgun of the sort loaded by inserting an ammunition-bearing magazine into the stock or handle may be provided with a longer stock by using a longer, but compatible, magazine and the stock extender of the present invention. The longer stock, of course, may be capable of holding one or more additional rounds. More importantly, the lengthened stock is more reliably gripped by larger-handed users, and enables such users to handle the handgun more comfortably and to shoot it more accurately.

Referring now to the figures, FIG. 1 shows a back view of the stock of a handgun with a magazine having the stock extender of the present invention partially inserted thereinto. More specifically, the stock extender 10 of the present invention is fitted in a collar-like fashion about an ammunition-bearing magazine 26, which is inserted into the lower end of the stock 30 of a handgun.

As may be observed, the stock extender 10 is provided with a split 12. A screw 14, disposed transversely across the split 12, may be used to tighten the stock extender 10 securely to the lower end of the magazine 26.

Typically, the lower end of the stock 30 is provided with bevels 32 for aesthetic or other purposes. The stock extender 10 is preferably shaped with inclined surfaces 16 matching bevels 32, so that the stock extender 10 may intimately fit against the lower end of stock 30. The outer circumferential contour 18 of the stock extender 10 corresponds to that of the stock 30. The stock extender 10 may also be provided with bevels 20 to provide the lower end of the stock extender 10 with the characteristics of the lower end of the stock 30.

FIG. 2 presents a side view of the stock of a handgun with the stock extender of the present invention positioned at the lower end thereof. Reference numerals identical to those used in FIG. 1 are used to identify identical parts in FIG. 2. The stock extender 10, when abutting the lower end of stock 30, forms a substantially continuous surface therewith for gripping by the user of the handgun. The stock extender 10 is shaped to intimately fit against the lower end of the stock 30. Stock extender 10 may have bevels 20 analogous to those found at the lower end of the stock 30 of the handgun.

FIG. 3 shows the stock extender 10 positioned over the upper end of an ammunition magazine 26, as it would be prior to installation thereon. In actual use, the stock extender 10 may be installed on ammunition magazine 26 by inserting the upper end through the opening 40 defined by the collar-like shape of the stock extender 10, and by sliding the magazine 26 through opening 40 until the stock extender 10 resides about the lower end of the magazine 26. Screw 14 may then be tightened to secure the stock extender 10 at that location on the magazine 26. Preferably, the opening 40 is dimensioned so that the stock extender 10 may fit snugly about the magazine 26 when screw 14 is tightened.

FIG. 4 is a cross-sectional view of an alternate embodiment of the stock extender of the present invention disposed about an ammunition magazine 26. The alternate embodiment stock extender 50 is circumferentially continuous; that is, stock extender 50 is not provided with a split 12. Rather, it is provided with a screw 52 directed inwardly through stock extender 50. When screw 52 is tightened, it bears directly against magazine 26 to maintain the stock extender 50 in the desired location at the lower end thereof. As before, the opening defined by the collar-like shape of the stock extender 50 is dimensioned so that it may fit snugly about the magazine 26 when screw 52 is tightened.

Modifications to the above would be obvious to those skilled in the art without bringing the stock extender so modified beyond the scope of the appended claims.

What is claimed is:

1. In a handgun of the variety having a stock, said stock being gripped by a hand of a user holding said handgun and into a lower end of which an ammunition-bearing magazine may be inserted to load said handgun, said magazine having an upper end, from which said ammunition is dispensed, and a lower end, said magazine being inserted upper end first into said stock when loading said handgun, the improvement comprising a stock extender, said stock extender being a collar defining an opening and fitting around the lower end of said magazine, said magazine being inserted through said opening up to said lower end, said magazine being longer than said stock and said stock extender having a thickness in an axial direction equal to the amount by which said magazine is longer than said stock, whereby said stock may be lengthened by an amount equal to the thickness of said stock extender to facilitate the gripping of said stock by a user of said handgun, wherein said stock extender is provided with a split at a point on the circumference thereof in an axial direction and with a screw directed transversely across said split, said screw, upon being tightened, narrowing said split to tighten said stock extender about said magazine.

2. The improvement as claimed in claim 1 wherein said opening of said stock extender is shaped to correspond to the cross-sectional shape of said magazine, so that said stock extender may fit snugly around said magazine.

3. The improvement as claimed in claim 1 wherein said stock extender has a cross section, taken in a transverse direction, which is shaped to correspond to the cross-sectional shape of said stock.

4. The improvement as claimed in claim 1 wherein said stock extender has an upper face and a lower face, said upper face having inclined surfaces so that said lower end of said stock and said upper face of said stock extender intimately corresponding to one another, and said lower face being bevelled to correspond to the lower end of said stock.

* * * * *